US005381686A

United States Patent [19]

Thorup

[11] Patent Number: 5,381,686

[45] Date of Patent: Jan. 17, 1995

[54] DUAL-ACTION PNEUMO-HYDRAULIC CRIMPING APPARATUS

[75] Inventor: James A. Thorup, Meadow Vista, Calif.

[73] Assignee: Coherent Inc., Santa Clara, Calif.

[21] Appl. No.: 206,445

[22] Filed: Mar. 3, 1994

[51] Int. Cl.[6] ..... B21D 9/08

[52] U.S. Cl. ..... 72/453.06; 72/453.15; 72/453.16

[58] Field of Search ..... 72/453.15, 453.16, 453.06

[56] References Cited

U.S. PATENT DOCUMENTS

| | | | |
|---|---|---|---|
| 2,941,430 | 6/1960 | Klingler | 72/453.16 |
| 3,263,481 | 8/1966 | Boyd et al. | 72/453.16 |
| 4,152,970 | 5/1979 | Hall et al. | 91/318 |
| 4,226,110 | 10/1980 | Suganuma | 72/416 |
| 4,494,398 | 1/1985 | Svoboda | 72/453.16 |
| 5,062,290 | 11/1991 | Hoover | 72/416 |
| 5,253,554 | 10/1993 | Riera et al. | 72/453.16 |

FOREIGN PATENT DOCUMENTS

| | | | |
|---|---|---|---|
| 0945354 | 4/1974 | Canada . | |
| 2316015 | 1/1977 | France . | |
| 2413150 | 8/1979 | France | 72/453.02 |
| 2813654 | 10/1978 | Germany | 72/453.15 |
| 0032400 | 9/1971 | Japan | 72/453.02 |
| 1433904 | 7/1976 | United Kingdom . | |
| 1578055 | 10/1980 | United Kingdom . | |

*Primary Examiner*—David Jones
*Attorney, Agent, or Firm*—R. Russel Austin

[57] ABSTRACT

An apparatus for crimping a terminal onto a wire includes a hydraulic cylinder including a hydraulic ram, two normally open crimper jaws closeable by the hydraulic ram, and a hydraulic pressure supply for delivering hydraulic pressure to the hydraulic cylinder to operate the hydraulic ram and close the crimper jaws. The hydraulic pressure may be applied initially at a first level sufficient to cause the crimper jaws to close on and grip the terminal but less than sufficient to cause the crimper jaws to crimp the terminal, and subsequently applied at a second, higher level sufficient to crimp the terminal.

6 Claims, 3 Drawing Sheets

DUAL-ACTION PNEUMO-HYDRAULIC CRIMPING APPARATUS

BACKGROUND OF THE INVENTION

The present invention is relates generally to apparatus for attaching a terminal to a wire by crimping the terminal onto the wire. It relates in particular to a dual action pneumo-hydraulically driven apparatus wherein pneumatic pressure is converted to hydraulic pressure in sequential stages for operating the apparatus.

A common operation in building an electronic circuit is crimping a terminal onto a wire for connecting the wire in the circuit. The terminal typically includes a circuit connector portion for attaching the terminal to the circuit, and a crushable or crimpable portion for attaching the terminal to the wire. The crushable portion of the terminal is usually in the form of an open-ended cylinder with a slot extending completely along the length of the cylinder. The cylinder has a diameter slightly greater than the wire.

The wire is first inserted into the cylinder, and the cylinder is then crushed or crimped onto the wire. This crushing or crimping operation is usually carried out by circuit builders using hand-held, hand-operated crimping pliers. The crimping pliers have jaws including crimping dies configured to crimp a particular size and form of terminal. Frequently, a circuit builder holds a terminal, with the crimpable portion thereof in the dies. The terminal is held using a light pressure sufficient to positively grip the terminal but not sufficient to crimp the crimpable portion of the terminal. The circuit builder then inserts the wire into the crimpable portion of the terminal, and finally closes the plier jaws with sufficient force to crush or crimp the terminal onto the wire. Constant repetition of this operation can lead to a circuit builder developing carpal tunnel syndrome, arthritis or the like. This, in turn, may lead to at least temporary and even to permanent loss of employment for the circuit builder.

Certain types of power apparatus, hydraulic or pneumatic, has been developed to perform crimping operations. Commercially available hydraulic apparatus however is usually bulky, and operates in a fixed position on a workbench. Work to be crimped must thus be taken to the apparatus. A circuit builder usually finds this awkward and restrictive. Further, hydraulic and pneumatic apparatus usually operates in a single crimping or crushing stroke of jaws and dies. This requires that a builder manually retain a terminal on a wire until the crimping stroke is completed. This requires more skill and judgement than holding a terminal in pliers while inserting a wire therein. Further there is a risk that a builder's fingers may be caught in the crimping jaws during the crimping stroke.

Because of the aforementioned problems, prior art power crimping apparatus has not been widely accepted in the circuit building industry. Circuit builders are usually willing to accept the physical effort required to operate manual crimping pliers, together with the attended carpal tunnel syndrome and like risks, in return for relative convenience and efficiency of use.

Clearly there is a need for power crimping apparatus which a circuit builder may use in a similar manner to manual crimping pliers. It is believed that were such apparatus commercially available it would be accepted enthusiastically, and widely used.

SUMMARY OF THE INVENTION

The present invention is directed to pneumo-hydraulic powered apparatus for attaching a terminal to a wire. The terminal includes a connector portion for connecting to a circuit, and a crushable or crimpable portion which is attachable to the wire. The terminal is attached to the wire by inserting the wire into the crushable portion and crushing the crushable portion of the terminal onto the wire.

In one aspect of the present invention, the apparatus comprises a hydraulic cylinder including a hydraulic ram and two normally-open crimper jaws closeable by the hydraulic ram. The crimper jaws are for closing onto, holding, and crimping the crimpable portion of the terminal after it is positioned between the open crimper jaws. A hydraulic pressure supply is provided for delivering hydraulic pressure to the hydraulic cylinder, via a hydraulic fluid, to operate the hydraulic ram and cause the crimper jaws to close.

The hydraulic power supply includes a converter or booster for applying pneumatic pressure to the hydraulic fluid for delivering the hydraulic pressure to the hydraulic cylinder. The pressure supply also includes means for first delivering a first pneumatic pressure to the converter for delivering the hydraulic pressure to the hydraulic cylinder at a first level, and subsequently delivering a second pneumatic pressure to the converter for delivering the hydraulic pressure to the hydraulic cylinder at a second level. The first hydraulic pressure level is sufficient to cause the crimper jaws to close on and grip the crimpable portion of the terminal but less than sufficient to cause the crimper jaws to crimp the crimpable portion of the terminal. The second hydraulic pressure level is sufficient to crimp the crimpable portion of the terminal.

In a preferred embodiment, the hydraulic cylinder is mounted on a handle and the crimper jaws are mounted on a crimper head. The crimper head is attached to the handle and includes a mechanical linkage for coupling the jaws to the hydraulic ram. The hydraulic pressure supply delivers hydraulic pressure to the hydraulic cylinder via a flexible hose or conduit.

The hydraulic pressure supply accepts compressed air from a compressed air supply, and delivers the compressed air to the converter means via a first pneumatic circuit to provide the first pneumatic pressure. The compressed air is subsequently delivered to the converter via a second pneumatic circuit to provide the second pneumatic pressure. Switching the compressed air between the first and second circuits is accomplished by electrically operated valves.

An operator of the apparatus is able to control the electrically-operated valves by a depressible foot-switch, thus leaving both of the operators hands free. The operator positions the crimpable portion of the terminal between the normally open jaws and depresses the foot-switch to cause the jaws to close under the first pneumatic pressure level. The jaws firmly grip the crimpable portion of the terminal without crimping it. The operator then inserts the wire into the crimpable portion of the terminal, and then further depresses the foot-switch to close the jaws under the second pneumatic pressure level, thus crimping the terminal onto the wire.

The apparatus may thus be used by an operator in a similar manner to a manual crimping pliers. The operator may use all normal wire and terminal handling movements to which he or she is accustomed when using manual crimping apparatus. The apparatus of the present invention has an advantage over such manual apparatus, however, in that no physical force is required to crimp a terminal.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

DETAILED DESCRIPTION OF THE INVENTION

Figure 1:
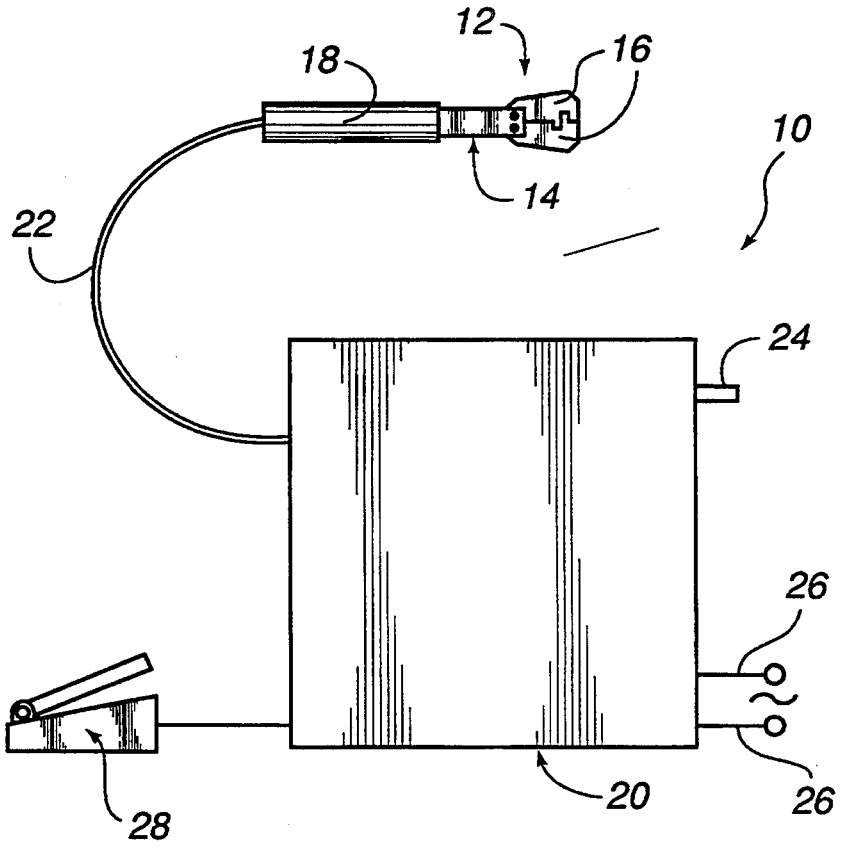
FIG. 1 schematically illustrates an overall view of one embodiment of apparatus in accordance with the present invention, including a handle, a crimper head including crimper jaws attached to the handle, and a hydraulic pressure supply.

Turning now to the drawings, FIG. 1 illustrates one embodiment 10 of pneumo-hydraulic crimping apparatus in accordance with the present invention. A crimper head 12 includes a body 14 to which are pivotally attached two crimper jaws or dies 16. A hydraulic pressure supply 20 provides hydraulic pressure for operating crimper jaws 16. The hydraulic pressure is delivered to the crimper jaws via a flexible conduit 22 to a hydraulic cylinder including a ram for operating the jaws. The cylinder and ram are not visible in FIG. 1.

Hydraulic pressure supply 20 requires a supply of a compressed gas, preferably compressed air. Such a compressed air supply is delivered to the pressure supply via a conduit 24. Hydraulic pressure supply 20 requires a source of electrical power, for example, at about 115 volts alternating current (115 VAC). This is delivered via terminals 26. Apparatus 10 is controlled by a dual-action foot-switch 28 in a manner which is described below.

Figure 2:
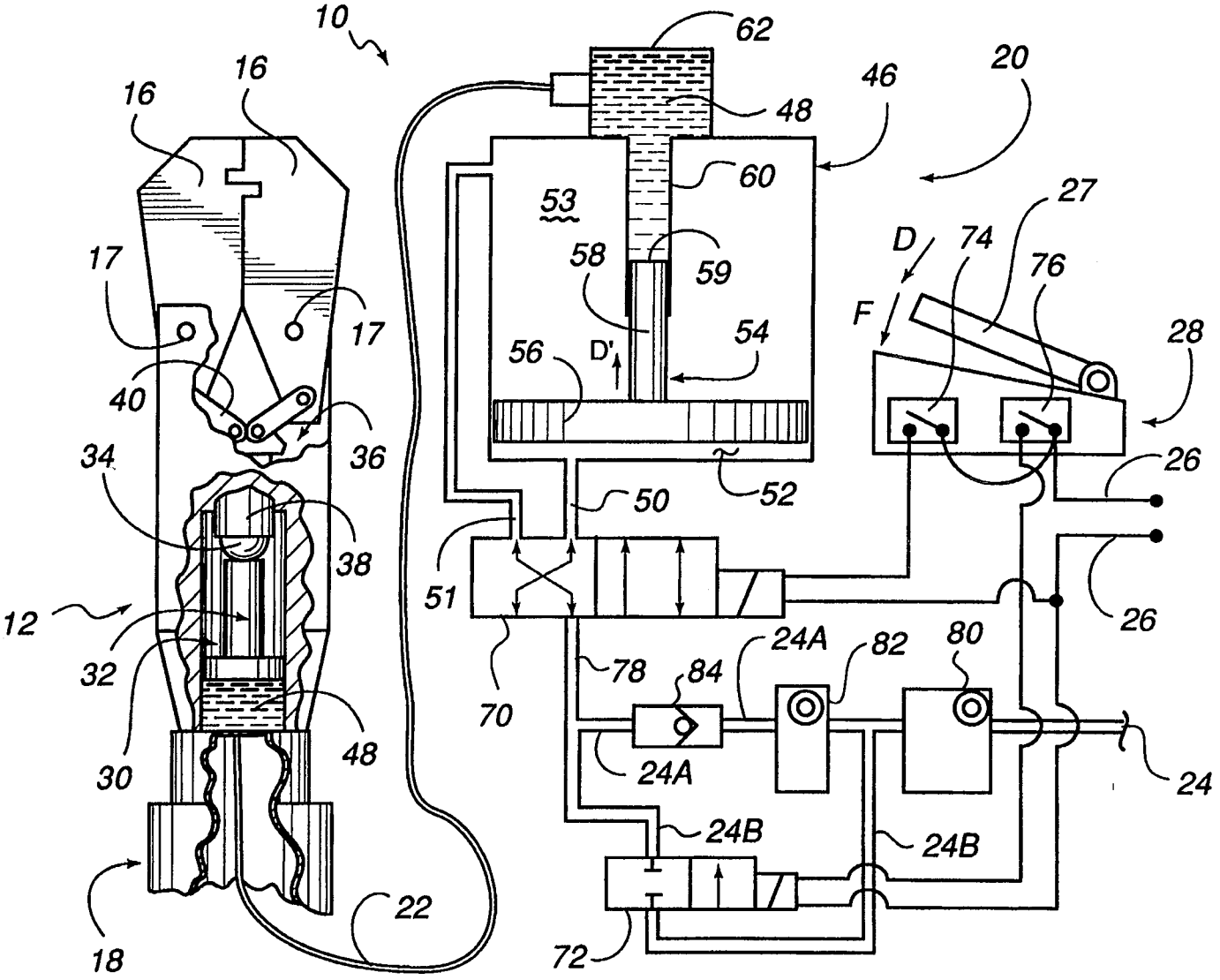
FIG. 2 is an overall view, partly in section, schematically illustrating details of the handle, crimper head, crimper jaws, and hydraulic pressure supply of the apparatus of FIG. 1.

Referring now primarily to FIG. 2, attached to handle 18 is a hydraulic slave cylinder 30, such as a 1.0 inch stroke, 0.442 square inch effective area model available from Enerpac Inc., of Butler, Wis. Hydraulic cylinder 30 drives a hydraulic ram 32 preferably having a ball tip 32 (shown only partly in FIG. 2). Hydraulic ram 32 operates crimper jaws 16 via a mechanical linkage 36, preferably a scissors linkage. Linkage 36 includes a thrust member 38, pivotally attached to scissors members 40. Thrust member 38 includes a hemispherical recessed end 43 for accepting ball tip 34 of hydraulic ram 32 (see FIG. 3). Each scissors member 40 is pivotally attached to a corresponding one of crimper jaws 16. Each crimper jaw 16 is pivotally attached to crimper head 12 by an axle 17 extending between spaced-apart flanges 13 (see FIGS. 3 and 4) of the crimper head.

Hydraulic pressure is supplied to hydraulic cylinder 30 via a hydraulic fluid 48 through conduit 22. Conduit 22 is preferably a three-thousand pounds per square inch (3000 psi) flexible hydraulic hose. The hydraulic pressure is provided by a converter or booster 46. Converter 46 converts a pneumatic pressure, delivered via a conduit 50 into a space 52 of the converter, into hydraulic pressure. Converter 60 includes a piston 54 including a piston head 56 and a plunger 58. Surface area of piston head 56 is preferably more than an order of magnitude greater than the tip area 59 of plunger 58. Pneumatic pressure delivered to space 52 is multiplied by over an order of magnitude at tip 59 of plunger 58, and applied to hydraulic fluid 48 in cylinder 60 and fluid reservoir 62 to provide hydraulic pressure. A preferred booster or converter is a Hydra-Dyne, Model 70101 having a boost ratio of about 33:1 and available from Destaco Inc., of Troy, Mich. In such a converter, a pneumatic pressure of about 85 psi may be boosted to a hydraulic pressure of over 2800 psi.

As discussed above, two hydraulic pressure levels are required for operation of the apparatus. The first hydraulic pressure level must be sufficient to cause the crimper jaws to close on and grip the crushable portion of a terminal but less than sufficient to cause the crimper jaws to crimp the crushable portion of the terminal. The second hydraulic pressure level must be sufficient to crimp the crimpable portion of the terminal. A preferred arrangement for achieving two such hydraulic pressure levels and operating crimper jaws 16, including electrically operated valves controlling pneumatic conduits, is described with continuing reference to FIG. 2 and also to FIGS. 3 and 4.

As illustrated in FIG. 2, electrically operated valves 70 and 72 are controlled by switches 74 and 76 of foot-switch 28. Valve 70 is a four-way air valve such as a 711C-12-P1-11BA available from MAC Corporation, of Wixom, Mich. Valve 72 is a two-way air valve such as a model 111B-111CA also available for MAC Corporation. Valve 70 routes air (pneumatic pressure), delivered thereto via conduit 78, into one of conduits 50 (into space 52 below piston head 56) or 51 (into space 53 above piston head 56). Compressed air, for example, at a pressure of about 100 psi is delivered to pressure supply 20 via conduit 24. This air may reach conduit 78 via a first pneumatic circuit including conduit 24A, regulators 80 and 82, and check valve 84. Alternatively, the air may reach conduit 78 via a second pneumatic circuit including conduit 24B and valve 72.

When foot-switch 28 is not depressed, switches 74 and 76 are open, valve 72 is closed and valve 70 connects conduit 78 with conduit 51. Air delivered to conduit 24 at about 100 psi passes through regulator 80. Regulator 80 is preferably a filter, regulator and lubricator unit such as a Micro Mate Model 41615K44, available from Norgren Inc. of Littleton, Colo. Regulator 80 treats air passing therethrough by removing moisture and particulates, adding a mist of cylinder lubricant, and reducing the air pressure to about 85 psi. Air passing along conduit 24A through regulator 82 is reduced in pressure to about 10 psi. This air is then delivered via conduits 78 and 51 to space 53 driving piston 54 into a fully retracted position. In this position, no hydraulic pressure is delivered by converter 46 to hydraulic cylinder 30.

Figure 3:
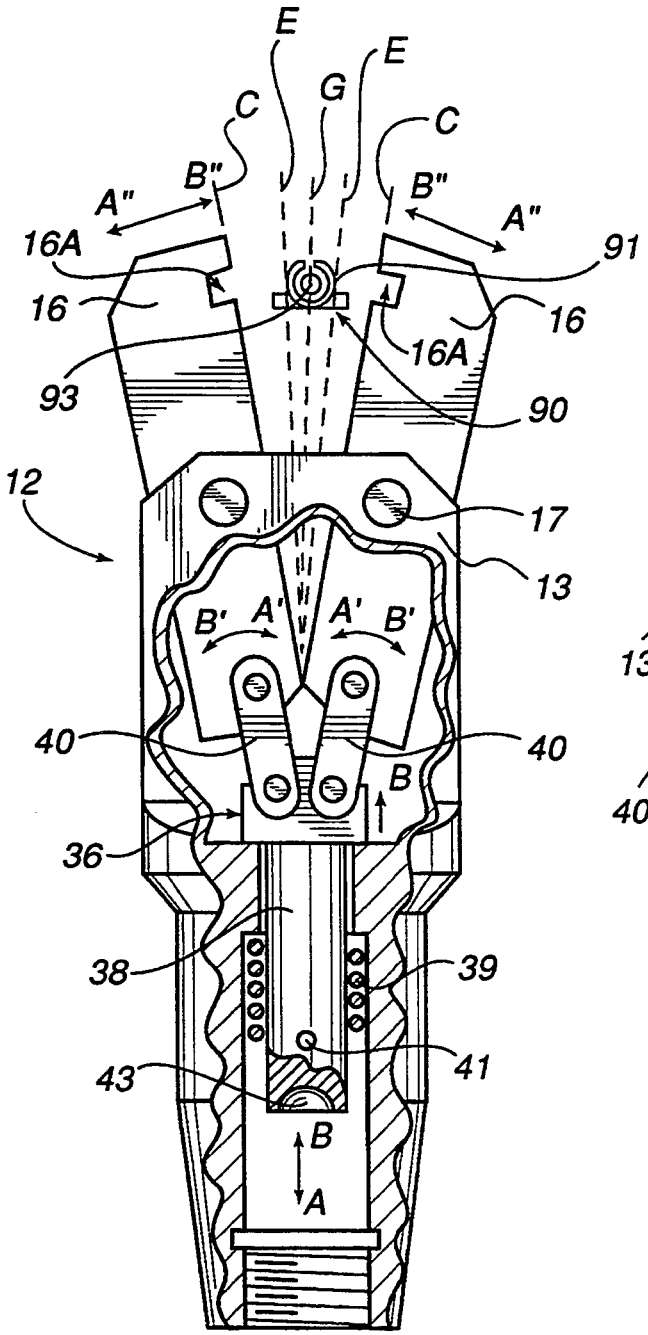
FIG. 3 is a side elevation view, partly in section, schematically illustrating further details of the crimper head of FIG. 2, including action of the crimper jaws with respect to a terminal and wire positioned therebetween.
Figure 4:
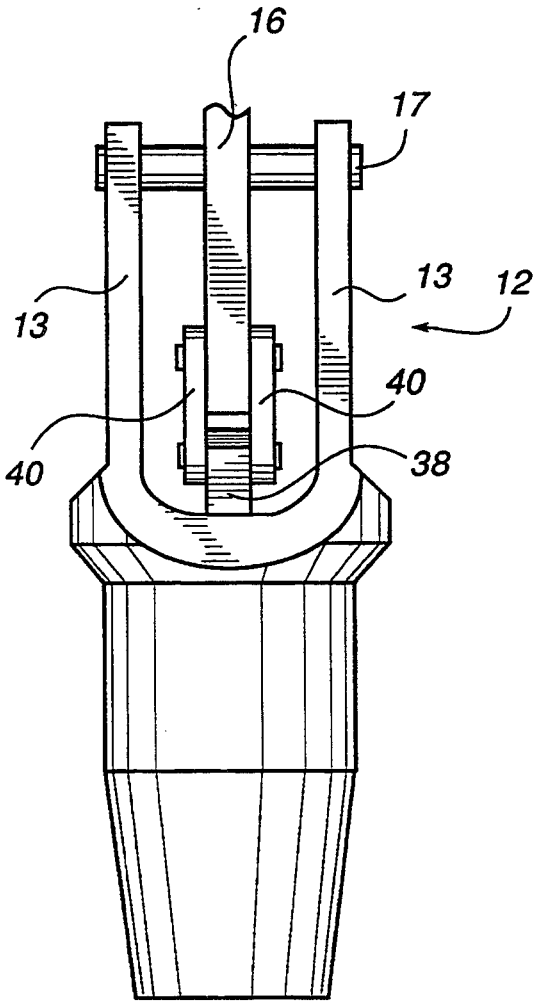
FIG. 4 is an end elevation view schematically illustrating the crimper head of claim 3.

Referring now to FIG. 3, when no hydraulic pressure is delivered to hydraulic cylinder 30, a spring 39 acting on a pin 41 drives thrust member 38 of linkage 36 in a direction indicated by arrow A. This causes crimper jaws 16 to move as indicated by arrows A' and A" into a normally-open position indicated in phantom by broken lines C. When jaws 16 are in this normally-open position, an operator of apparatus 10 inserts a terminal 90 with a crimpable portion 91 thereof located between die portions 16A of jaws 16. It should be noted here that, throughout this description, a jaws 16 is sometimes referred to interchangeably as a die, even though only a portion thereof actually forms a die.

Referring again to FIG. 2, when platform 27 of foot-switch 28 is depressed, as indicated by arrow D, switch 74 is closed. Closing switch 74 causes 10 psi air being delivered via conduit 24A to be delivered via conduit 78 to conduit 50 (via the first pneumatic circuit) and into space 52, thus driving piston 54 in a direction indicated by arrow D'. This delivers pneumatic pressure at a first, "soft-touch", level via conduit 22 to hydraulic cylinder 30. This drives hydraulic ram 32, and thus drives thrust member 38 in a direction indicated in FIG. 3 by arrows B. Continuing with reference to FIG. 3, in response to this thrust member movement, jaws 16 will move as indicated by arrows B' and B" and close on crimpable portion 91 of terminal 90.

The first pneumatic pressure is selected such that it provides a first hydraulic pressure level which is not sufficient to crimp portion 91. Thus when jaws 16 reach crimpable portion 91 they can move no further without being driven by increased pressure. With pneumatic pressure at this first level, jaws 16 will thus stop at a first position indicated in phantom by broken lines E. Jaws 16 will grip and hold terminal 90 by crimpable portion 91 thereof in this position without actually crimping the crimpable portion of the terminal. With terminal 90 thus held in jaws 16, the operator inserts a wire 93 into the crimpable portion of the terminal. It should be noted here that a minor deformation of crimpable portion 91 may be permissible provided such deformation is not sufficient to prevent insertion of wire 93 therein.

Referring once again to FIG. 2, once wire 93 is inserted, the operator further depresses platform 27 of foot-switch 28 as indicated by arrow F. Switch 74 remains closed and switch 76 is also closed. Closing switch 76 opens valve 72 and delivers 85 psi air via conduit 24B, conduit 78 and conduit 50 into space 52 of converter 46 (the second pneumatic circuit). Check valve 84 prevents the higher pressure air from entering the first pneumatic circuit.

Application of the 85 psi air drives piston 54 further in a direction indicated by arrow D', which delivers pneumatic pressure at a second, "crimping", level via conduit 22 to hydraulic cylinder 30. This, in turn, drives hydraulic ram 32, and thus drives thrust member 38 further in a direction indicated in FIG. 3 by arrows B.

Continuing again with reference to FIG. 3, in response to this further thrust member movement, jaws 16 will move as indicated by arrows B' and B" until the crimping pressure is overcome by physical resistance presented by the crimped terminal and the wire. Thus the jaws will stop at a second position indicated by arrow E wherein the terminal is crimped onto the wire.

Referring yet again to FIG. 2, once the terminal is crimped, the operator may fully release foot-switch 28. Fully releasing foot-switch 28 opens switches 74 and 76. This closes valve 72, switches valve 70 to connect conduit 78 with conduit 51, and thus directs 10 psi air via conduit 24A, conduit 78 and conduit 51 into space 53. This, in turn, retracts plunger 58 from cylinder 60 of converter 46 and stops delivery of hydraulic pressure to hydraulic cylinder 30.

Referring yet again to FIG. 3, absent any hydraulic pressure in hydraulic cylinder 30, spring 39 drives thrust member 38 in the direction of arrow A, thus returning jaws 16 to their normally open position C as described above. The operator may then remove the crimped terminal and wire, and apparatus 10 is ready for another crimping cycle.

It will be evident to those skilled in the art to which the present invention pertains that the exemplary pneumatic pressures delivered to conduit 24 and regulated by regulators 80 and 82 are not limiting. These pressures may be different depending several factors, for example, the normal pressure of a compressed air supply, the type of converter used, and the actual design of crimper head and jaws, and pneumatic pressures required to crimp a particular type of terminal.

It should be noted here that the crimping sequence described is a sequence frequently used in crimping operations. This sequence should not, however, be considered as a limiting use of the apparatus of the present invention, as users of the apparatus may prefer a somewhat different operating sequence.

In summary, a simple, easily portable crimping apparatus has been described. The apparatus includes only a single hydraulic circuit involving a single hydraulic conduit. Hydraulic pressure is generated by converting readily available pneumatic pressure which is frequently a standard delivered utility in electronic circuit assembly work-space.

In considering the forgoing description of apparatus in accordance with the present invention, many useful advantages thereof will be evident to one skilled in the art to which the present invention pertains. Generally, after only a brief period of adjustment (certainly less than a day), an operator should find the apparatus easier to use than manual crimping apparatus. Specifically, as no physical manual force is required to crimp a terminal, the possibility of an operator developing carpal tunnel syndrome and like problems is very significantly reduced.

The apparatus of the present invention is inherently safe to use. One reason is that the soft touch hydraulic pressure feature for holding a terminal while a wire is positioned therein affords the operator an opportunity to remove his or her hands from the vicinity of the crimper jaws before crimping pressure is delivered to the jaws. Provision of regulators for setting both "soft touch" and "crimping" pneumatic power levels allows an operator, to a certain extent, to customize the apparatus to suit his or her personal operating preferences.

As the apparatus of the present invention is described above, cut-off of electric power to the apparatus or hydraulic failure will cause the crimper jaws of the crimper head to open. The apparatus is thus inherently fail-safe. This is an additional feature which contributes to operator safety and operator acceptance of the apparatus.

Finally, but not exhaustively, the apparatus does not require a motor or a pump for producing hydraulic pressure. Such motors or pumps often operate with an annoying hum or rattle which may prove offensive to an operator. Similarly the apparatus does not require pneumatically operated valves which often operate with an annoying explosive hiss. The apparatus is thus exceptionally quiet in operation, providing yet another factor which contributes to operator comfort, safety and acceptance of the apparatus.

The present invention has been described and depicted in terms of a preferred and the embodiments. The invention, however, is not limited however to the embodiments describe and depicted. Rather the invention is limited only by the claims appended hereto.

What is claimed is:

1. Apparatus for attaching a terminal to a wire, the terminal including a crimpable portion and attachable to the wire by inserting the wire into the crimpable portion and crimping the crimpable portion onto the wire, the apparatus comprising:

a hydraulic cylinder including a hydraulic ram, two normally open crimper jaws closeable by the hydraulic ram, the crimper jaws for closing onto, holding, and crimping the crimpable portion of the terminal after it is positioned between the crimper jaws, and a hydraulic pressure supply for delivering hydraulic pressure to said hydraulic cylinder via a hydraulic fluid to operate said hydraulic ram and cause said crimper jaws to close;

said hydraulic pressure supply including converter means for applying pneumatic pressure to said hydraulic fluid to deliver said hydraulic pressure to said hydraulic cylinder, and means for sequentially delivering a first pneumatic pressure to said converter means for delivering said hydraulic pressure to said hydraulic cylinder at a first level and a second pneumatic pressure to said converter means for delivering said hydraulic pressure to said hydraulic cylinder at a second level;

said sequential pneumatic pressure delivery means including means for accepting compressed air, means for delivering said compressed air to said converter means via a first pneumatic circuit to provide said first pneumatic pressure and via a second pneumatic circuit to provide said second pneumatic pressure, valve means for switching said compressed air between said first and second pneumatic circuits;

said first pneumatic circuit including first regulator means for adjusting said first pneumatic pressure and said second pneumatic circuit including second regulator means for adjusting said second pneumatic pressure; and said first hydraulic pressure level sufficient to cause said crimper jaws to close on and grip the crimpable portion of the terminal but less than sufficient to cause said crimper jaws to crimp the crimpable portion of the terminal, and said second hydraulic pressure level sufficient to crimp the crimpable portion of the terminal.

2. The apparatus of claim 1 wherein said valve means are electrically operated via foot-switch means.

3. Apparatus for attaching a terminal to a wire the terminal including a crimpable portion and attachable to the wire by inserting the wire into the crimpable portion and crimping the crimpable portion onto the wire, the apparatus comprising:

a handle, said handle having a hydraulic cylinder including a hydraulic ram member located therein, said hydraulic cylinder supplied with hydraulic pressure from a hydraulic pressure supply;

a crimper head attached to said handle, said crimper head including two crimper jaws each thereof pivotally attached to said crimper head, linkage means pivotally attached to said crimper jaws and cooperative with said hydraulic ram for closing the crimper jaws;

said crimper jaws normally open for inserting the crimpable portion of the terminal therebetween, closeable to a first position wherein the crimpable portion of the terminal is gripped by the crimper jaws, and further closeable to a second position for crimping the crimpable portion of the terminal onto the wire;

said hydraulic pressure supply including converter means for applying pneumatic pressure to a hydraulic fluid to provide said hydraulic pressure, conduit means attached to said converter means and said hydraulic cylinder for transmitting said hydraulic pressure via said hydraulic fluid to said hydraulic cylinder for operating the hydraulic ram;

said hydraulic pressure supply including means for sequentially delivering a first pneumatic pressure to said converter means for providing a first hydraulic pressure for closing said crimper jaws to said first position, and a second pneumatic pressure for providing a second hydraulic pressure greater than said first hydraulic pressure for closing said jaws to said second position, means for accepting air at a predetermined pressure, means for delivering said air to said converter means via a first pneumatic circuit to provide said first pneumatic pressure and via a second pneumatic circuit to provide said second pneumatic pressure, and valve means electrically operated via foot-switch means for switching said between said first and second pneumatic circuits; and said first pneumatic circuit including first regulator means for adjusting said first pneumatic pressure and said second pneumatic circuit including second regulator means for adjusting said second pneumatic pressure.

4. The apparatus of claim 3 wherein said first hydraulic pressure is sufficient to cause the crimper jaws to close on and grip the crimpable portion of the terminal but less than sufficient to cause the crimper jaws to crimp the crimpable portion of the terminal, and said second hydraulic pressure level is sufficient to crimp the crimpable portion of the terminal.

5. The apparatus of claim 3 wherein said crimper head is removably attached to said handle portion.

6. The apparatus of claim 3 wherein said handle is remotely located from said hydraulic pressure supply and said conduit means is a flexible hose.

* * * * *